US007595741B2

(12) United States Patent
Hovestadt

(10) Patent No.: US 7,595,741 B2
(45) Date of Patent: Sep. 29, 2009

(54) TRAFFIC VIOLATION INFORMATION SYSTEM

(76) Inventor: Guido Hovestadt, Hohe Strasse 30, 58739 Wickede Ruhr (DE)

( * ) Notice: Subject to any disclaimer, the term of this patent is extended or adjusted under 35 U.S.C. 154(b) by 124 days.

(21) Appl. No.: 11/287,496

(22) Filed: Nov. 25, 2005

(65) Prior Publication Data

US 2006/0220905 A1 Oct. 5, 2006

(30) Foreign Application Priority Data

Nov. 24, 2004 (EP) ..... 04027861

(51) Int. Cl.
*G08G 1/123* (2006.01)

(52) U.S. Cl. ..... 340/995.13; 340/936; 340/441; 340/905; 701/117; 701/119

(58) Field of Classification Search ..... 340/995.13, 340/995.24, 933, 936, 441, 905; 701/117, 701/119, 93
See application file for complete search history.

(56) References Cited

U.S. PATENT DOCUMENTS 5,819,198 A 10/1998 Peretz ..... 701/117
6,163,277 A 12/2000 Gehlot ..... 340/905
6,810,328 B2 * 10/2004 Yokota et al. ..... 701/210
2002/0019703 A1 2/2002 Levine ..... 701/301
2002/0173881 A1 * 11/2002 Lash et al. ..... 701/1
2003/0125981 A1 * 7/2003 Pedrazzoli Pazos ..... 705/1
2007/0038368 A1 * 2/2007 Miyawaki et al. ..... 701/207

FOREIGN PATENT DOCUMENTS

GB 2363200 A 12/2001

* cited by examiner

*Primary Examiner*—Daniel Wu
*Assistant Examiner*—Hongmin Fan
(74) *Attorney, Agent, or Firm*—The Eclipse Group LLP

(57) ABSTRACT

A driver information system is disclosed for providing driving information to the driver of a vehicle. The system comprises a traffic rule database including traffic rules for geographical regions, a position detecting unit for detecting the actual position of the vehicle, a driving parameter detecting unit for detecting at least one driving parameter of the vehicle, a control unit for extracting relevant traffic rules for the detected vehicle position from the traffic rule database and for comparing the extracted traffic rules to the detected at least one driving parameter in order to detect a traffic rule violation, a traffic rule violation significance judgment unit for judging the significance of a traffic rule violation detected by the control unit and for deciding whether information regarding the detected traffic rule violation is presented to the driver.

20 Claims, 6 Drawing Sheets

TRAFFIC VIOLATION INFORMATION SYSTEM

CROSS REFERENCE TO RELATED APPLICATION(S)

This application claims priority of European Patent Application Ser. No. 04 027 861.6, filed on Nov. 24, 2004, titled DRIVER INFORMATION SYSTEM, which is incorporated by reference in this application in its entirety.

FIELD OF THE INVENTION

This invention relates generally to computer-based navigation systems and more particularly to a driver information system for providing driving information to the driver of a vehicle.

BACKGROUND

Computer-based navigation systems provide end users with various navigation functions and features. These navigation systems normally determine an optimum route from a starting location to a destination location in a geographic region by using the input from the driver and from a position detecting unit, e.g., a GPS system. The navigation system may also provide the end user with additional information, some of which may include traffic rules, such as speed limits. However, the driver may not understand the consequences for failing to comply with traffic rules. Drivers are especially at a disadvantage in foreign countries where a minor violation of traffic rules may have consequences of which a driver is not aware. Accordingly, a need exists for a driver information system that informs the driver of traffic rule violations and the consequences the violation of traffic rules.

SUMMARY

A driver information system is described that provides traffic rules and traffic violation information to a driver of a vehicle. The driver information system includes a traffic rule database of traffic rules for geographical regions. The system further includes a position detecting unit for detecting the position of the vehicle. The driver information system also includes a driving parameter detecting unit that detects at least one driving parameter of the vehicle and a control unit that extracts relevant traffic rules for the detected vehicle position from the traffic rule database. The driver information system compares the extracted traffic rules to the detected at least one driving parameter to detect a traffic rule violation. The driver information system further includes a traffic rule violation significance judgment unit for judging the significance of a traffic rule violation detected by the control unit and for deciding whether information regarding the detected traffic rule violation is presented to the driver.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

Figure 1:
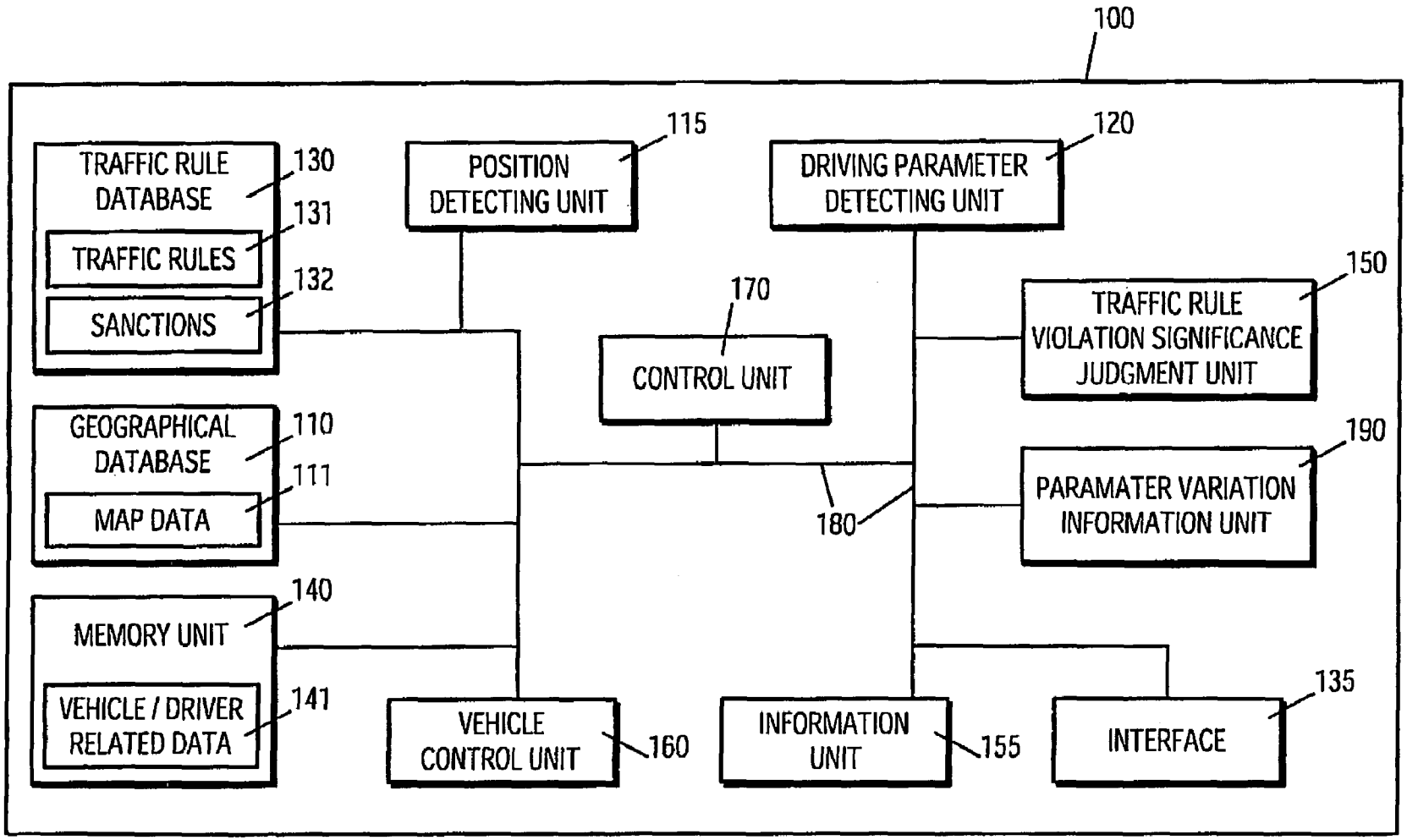
FIG. 1 is a schematic representation of one example of one implementation of a driver information system.

In FIG. 1, a driver information system 100 is schematically shown. The driver information system could be part of a vehicle navigation system incorporated in many present-day vehicles. The driver information system 100 includes a geographical database 110 having map data 111. The map data 111 represents physical features of geographical regions and comprise all the data necessary for guiding a driver from a present location to a predetermined destination location. Furthermore, a position detecting unit 115 is provided that is able to detect the present position of the vehicle, e.g., by using GPS signals in combination with signals from a steering wheel sensor and from a speedometer. It should be understood that any other possibility of detecting the present position of the vehicle could be used. Furthermore, a driving parameter detecting unit 120 is provided that detects at least one driving parameter. In the present context, driving parameter could be a parameter relating to the vehicle or relating to the driver. Examples of a driving parameter could be vehicle speed, engine speed, the type of vehicle used by the driver, driver-related information, e.g., age or years of driving experience, and whether the driver uses a mobile phone while driving, etc. In general, the more driving parameters are controlled, the better the traffic rules can be supervised.

The driver information system may further include a traffic rule database 130. The traffic rule database 130 includes traffic rules 131 and the corresponding possible sanctions 132 resulting from the non-observance of a traffic rule. In the illustrated example, the traffic rule database and the geographical database are indicated as separate units. However, it is also possible that one database is used comprising the map data 111, the traffic rules 131 and the sanctions 132. There are many different ways of arranging the traffic rules 131 and the corresponding sanctions 132. The traffic rule database 130 may also have position information, so that based on the position detected by the position detecting unit 115 the traffic rules 131 for this position can be extracted from the traffic rule database 130.

The different databases can either be installed inside the vehicle, or, it is also possible that the traffic rule database or the geographical database be arranged at a centralized server unit, this server unit being used by many vehicles. It is also possible that the vehicle, when it enters a predetermined geographical region, receives the traffic rules 131 and the corresponding sanctions 132 via an interface or communication unit 135 provided in the vehicle. There are many different ways of exchanging data by using wireless communication protocol. Any way of exchanging data could be used, by which the traffic rules and the corresponding sanctions can be transferred to the vehicle and to the driver information system 100.

In some cases, the traffic rules and/or the corresponding sanctions may depend on the vehicle itself or on the driver using the vehicle. The vehicle or the driver may have special permits that allow the use of roads closed to other vehicles, or the driver may be an inexperienced driver, so that for this driver other speed limitations are valid than are for more experienced drivers. Therefore, a memory unit 140 may be included for storing vehicle-related or driver-related data 141.

In many cases, the driver may not want to be informed of every small traffic rule violation, e.g., the driver drives several kilometers/hour (1 to 5 km/h) too fast. As a consequence, it may be determined whether the information regarding the detected traffic rule violation is presented to the driver. To this end, a traffic rule violation significance judgment unit 150 may be provided. The driver may be able to configure the system by setting a sanction limit value. All traffic rule violations and the corresponding sanctions are then judged as to their significance, i.e., whether the respective sanction is higher than the sanction limit value. If the sanction resulting from a traffic rule violation is lower than the sanction limit value, the traffic rule violation significance judgment unit 150 judges the traffic rule violation as not being significant. When a traffic rule violation is judged to be significant, an information unit 155 informs the driver of the traffic rule violation. The information unit 155 may inform the driver of a detected driving parameter that does not comply with the traffic rules in combination with the corresponding sanction resulting from the non-observance of the traffic rule.

There are different ways of informing the driver of a traffic rule violation and the sanction. One possibility way is to display the traffic rule violation and its sanction on a display unit that is normally provided in a vehicle navigation system. Furthermore, the way of informing the driver may depend on the value of the sanction. The driver may visually and/or audibly be warned of a traffic rule violation. If the traffic rule violation is considered to be important, the color of the display informing the driver may be changed, e.g., from green over orange to red, or any other parts of the dashboard or the dashboard illumination could be used to inform the driver of a traffic rule violation.

Furthermore, a vehicle control unit 160 may be provided that may actively control the different driving parameters, if needed. The vehicle control unit 160 may change the vehicle speed, if the actual vehicle speed exceeds the speed limit by a certain amount, or may actuate and turn on or off the lights of the vehicle. It should be understood that there are many other driving parameters that the vehicle control unit 160 could control when the traffic rule violation significance judgment unit 150 considers a traffic rule violation to be important.

A parameter variation information unit 190 may be provided that informs the driver when a variation of the driving parameter would lead to another sanction. For instance, unit 190 can inform the driver that by lowering the speed by a certain amount a speeding ticket can be avoided.

Furthermore, a central control unit 170 may be provided for controlling the proper functioning of the whole driver information system 100. The different limits shown in FIG. 1 are connected to each other and can communicate to each other by using a centralized bus system 180.

Figure 2:
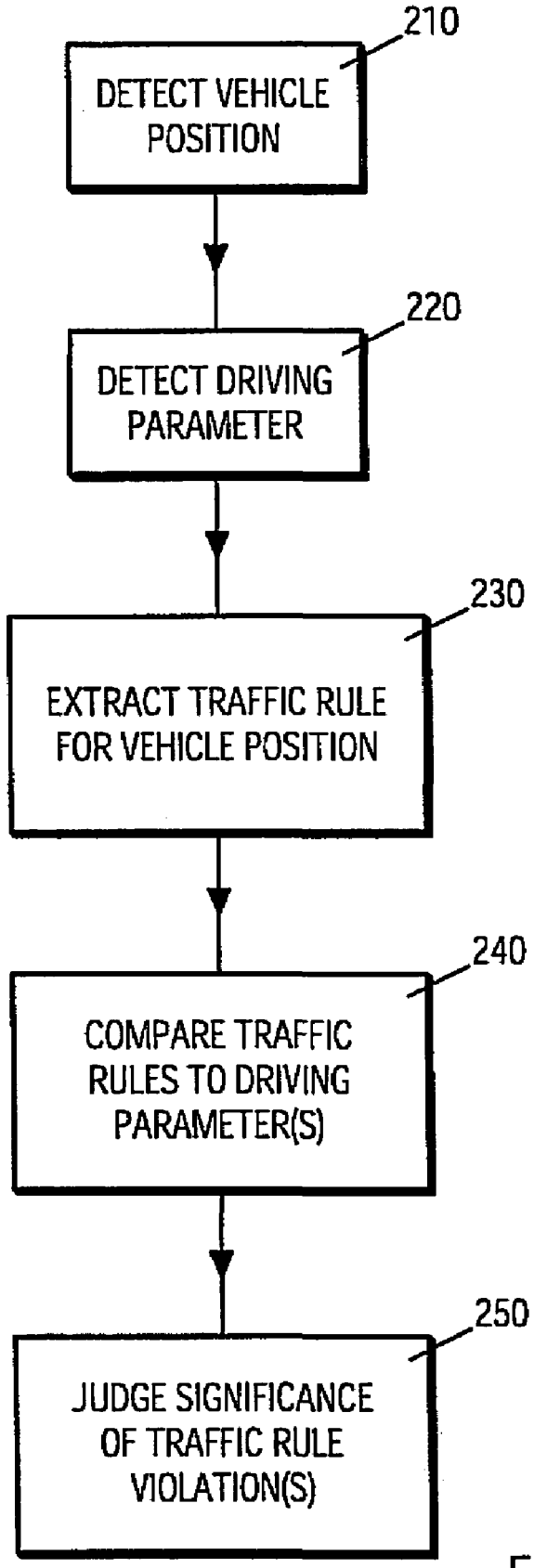
FIG. 2 is a flowchart illustrating examples of different steps that may be utilized to provide driving information to a driver.

In FIG. 2, the different steps are shown that can be used for deciding whether information regarding a detected traffic rule violation is presented to the driver. To determine what traffic rules should be applied, the actual vehicle position is detected in step 210. For some traffic rules, it is sufficient to know the country in which the vehicle is driven, for other traffic rules, such as speed limits, the vehicle position has to be detected in more detail, i.e., the road on which the vehicle is driven has to be determined. Other traffic rules apply for a whole country, e.g., whether the lights have also to be turned on during daytime, or whether driving and using a cellular phone at the same time is allowed or not. In step 220, at least one driving parameter is detected by the driving parameter detecting unit 120. Preferably, several different driving parameters may be detected at the same time, so that the violation of different traffic rules can be considered.

In step 230, the traffic rules for the vehicle position are extracted from the traffic rule database 130. The traffic rules can be organized and stored in the traffic rule database 130 in different ways. The traffic rules could be stored depending on the geographical region, i.e., the traffic rules that are valid for the whole country and traffic rules that only apply in certain geographic areas. The traffic rules could also be organized depending on the different driving parameters which should be considered, i.e., traffic rules for the speed limits, traffic rules for parking, etc. Depending on the detected driving parameter and on the accuracy of the detected vehicle position the traffic rules relevant for the vehicle position are extracted. In the next step 240, these traffic rules are then compared to the detected at least one driving parameter or driving parameters. Preferably, different driving parameters are detected, so that the different traffic rules can be considered and taken into consideration for judging the significance of the traffic rule violation in step 250. In step 250, it may also be decided whether the information regarding the detected traffic rule violation is presented to the driver or not. In this step 250, the significance of the resulting traffic rule violation may be considered in the case that more than one driving parameter does not comply with the traffic rules in step 240. The traffic rule violation significance judgment unit 150 bases its decision whether the driver is informed on the resulting traffic rule violation.

Figure 3:
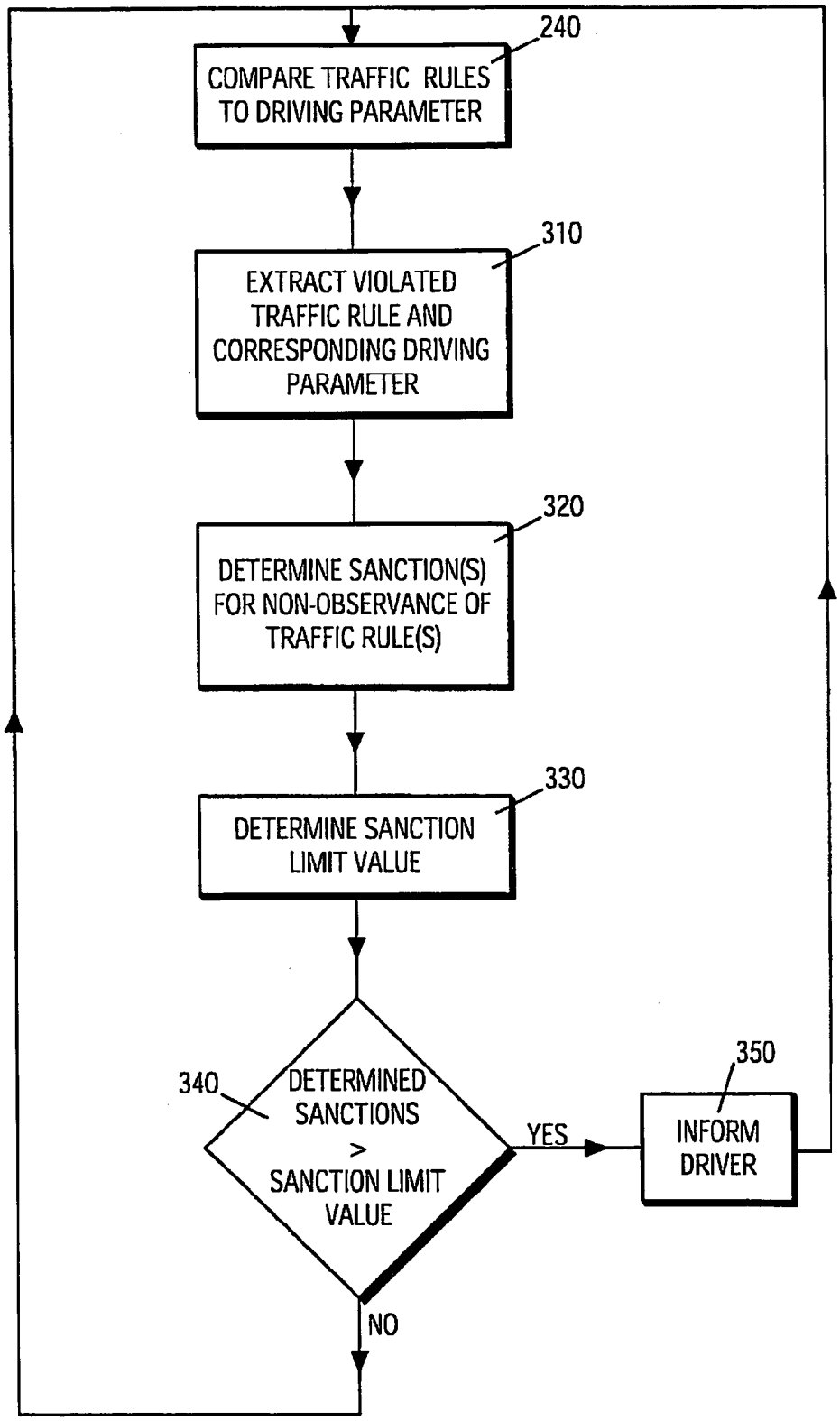
FIG. 3 is a flowchart illustrating more detailed example steps of a driver may be informed of different traffic rules and the corresponding sanctions.

The way of determining whether the information regarding the detected traffic rule violation is presented to the driver or not is explained in FIG. 3 in more detail. As already discussed in connection with FIG. 2, the traffic rules are compared to the driving parameter as shown in step 240 of FIG. 2. In step 310, the violated traffic rule is extracted after the traffic rules are compared to the present driving parameters. Together with the extracted traffic rule the corresponding driving parameter is extracted in step 310. In step 320 the sanction or sanctions for non-observance of the traffic rule or traffic rules are determined. When it is decided in step 310 that more than one traffic rule has been violated, all the possible sanctions relating to the non-observance of the traffic rules are determined in step 320 and are summed up.

In step 330, a sanction limit value is determined. This sanction limit value may be set by the driver, so that the driver himself/herself can set a limit above which he/she wants to be informed of a traffic rule violation. In step 340, the sanctions determined in step 320 are compared to the sanction limit value. If the determined sanction or the determined sanctions or the sum of them are greater than the sanction limit value, the driver will be informed in step 350 of a possible traffic rule violation and the corresponding sanction due to the non-observance of the traffic rule. The driver is then able to adapt the driving parameter or the respective driving parameters in accordance with the rules.

If the determined sanction is lower or smaller than the sanction limit value, the driver is not informed of the possible traffic rule violation. It may be the case that the driver does not want to be informed when he/she does not comply with the rules (e.g. when the actual vehicle speed exceeds the speed limit by a very small amount). The system then returns to step 240 and continues to compare the traffic rules to the driving parameters.

Figure 4:
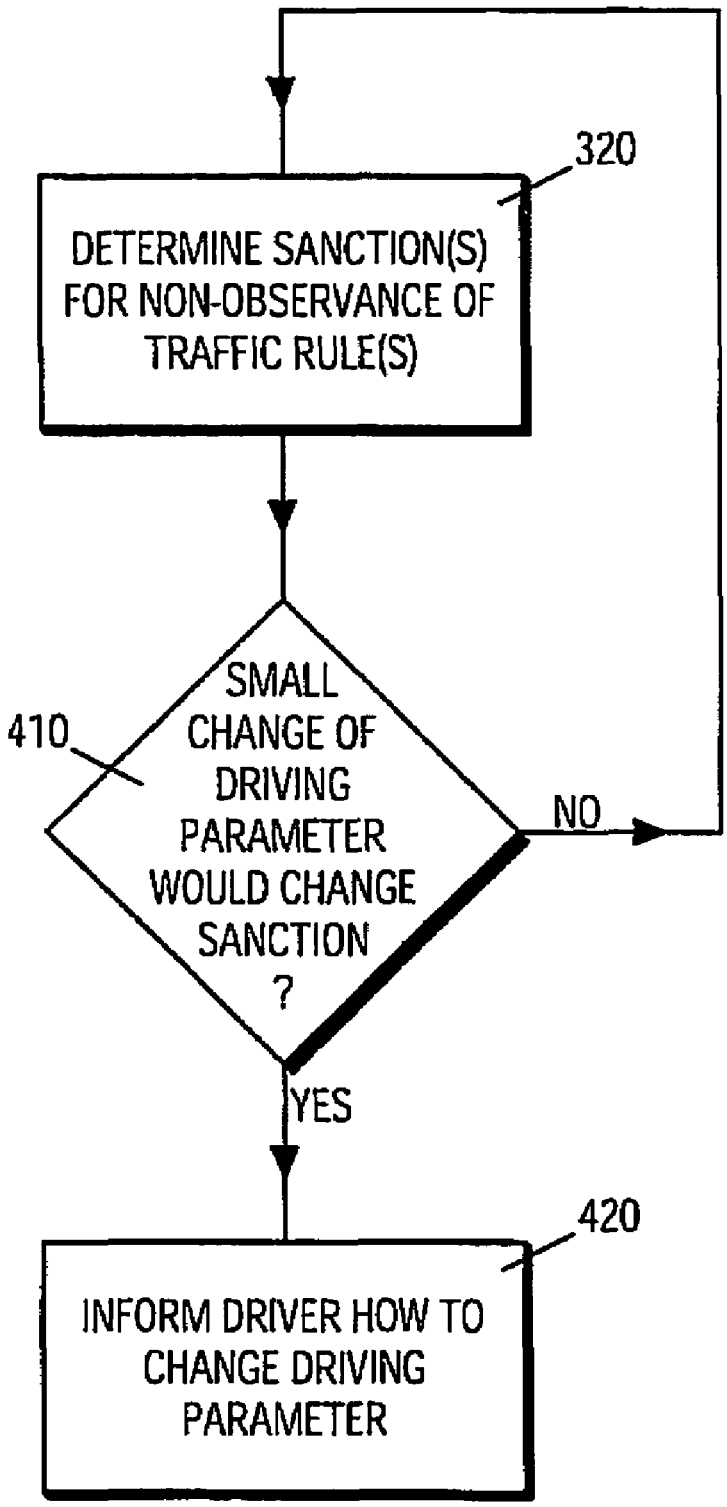
FIG. 4 is a flowchart illustrating more detailed example steps of a driver information system.

In FIG. 4, another additional feature of the invention is shown in more detail. As explained in connection with FIG. 3, the sanctions for the non-observance of the traffic rule or traffic rules are determined in step 320. In another step 410 it may be asked whether a small change of the driving parameter resulting in a sanction would change the sanction itself. It may be possible that when lowering the vehicle speed by a small amount (e.g. between 1 and 10 km/h), the corresponding sanction would also change. Normally, the sanctions are divided into different groups, e.g., a first sanction for exceeding the speed limit by 10 to 20%, another sanction for exceeding the speed limit from 21 to 30%, etc. In the steps shown in FIG. 4, the driver can be informed that by changing the detected driving parameter by a certain amount the corresponding sanction would also be changed. If it is detected in step 410 that a small change of the driving parameter changes the sanction, the driver may be informed in step 420 how to change the driving parameter to avoid a certain consequence. The steps shown in FIG. 4 help to avoid unnecessarily high sanctions due to traffic rule violations. The driver can adapt the driving parameter accordingly, so that the corresponding sanction resulting from the non-observance of the traffic rule can either be lowered or prevented.

Figure 5:
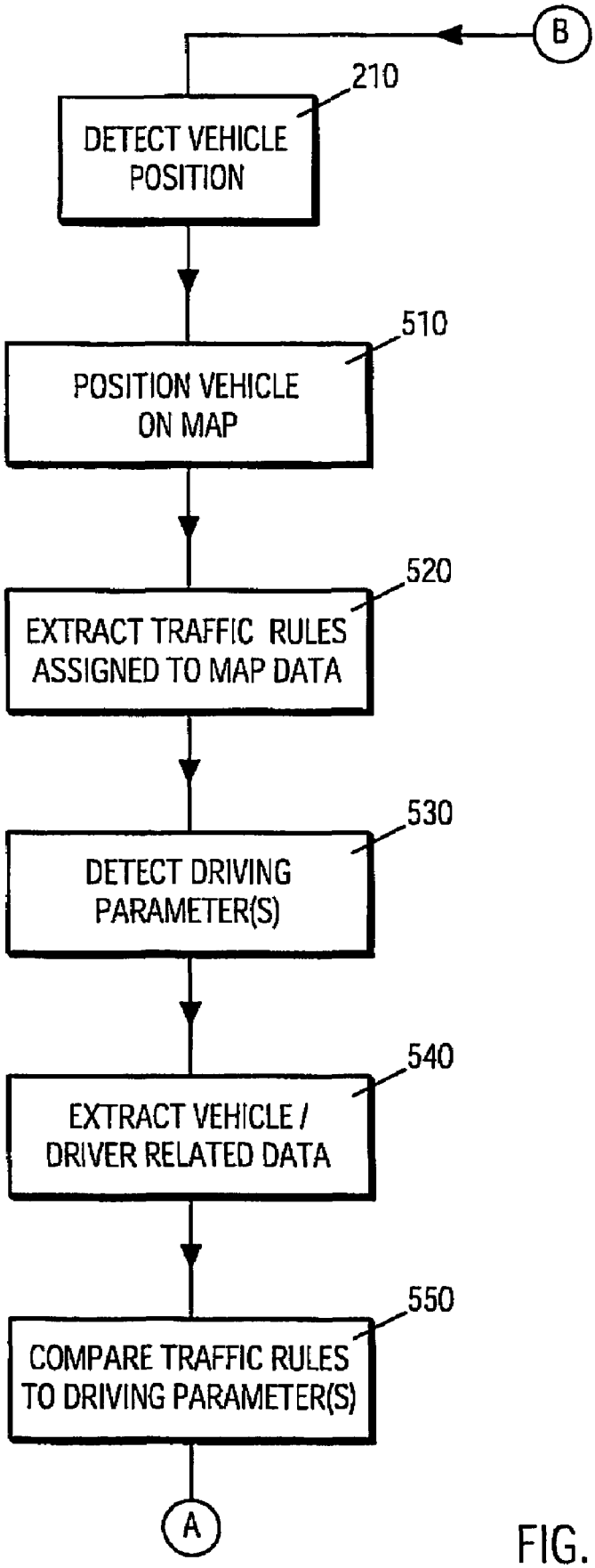
FIG. 5 is a flowchart illustrating the steps how, in detail, a driver may be informed of a traffic rule violation and of the corresponding sanction.

In FIG. 5, the different steps of informing the driver of a traffic rule violation are shown in more detail. As discussed in connection with FIG. 2, the vehicle position is detected in step 210. In step 510, the vehicle position is determined in a geographical sense from the map. For example, the vehicle position determined in step 510 may inform the road on which the vehicle is moving. The vehicle position determined in step 510 preferably permits a correlation between the vehicle position and the traffic rules that apply. This information may permit a determination of the speed limit, the direction the vehicle is allowed to move in, the places where the vehicle is allowed to park, etc. The determination of the exact position of the vehicle on the map in step 510 allows extraction of the corresponding traffic rules assigned to the map data in step 520. Additionally, the driving parameters may be detected as shown in step 530.

The traffic rules that apply may also depend on vehicle-related or driver-related data, which may be extracted in step 540. The system may access the memory unit 140 to extract the vehicle/driver-related data 141. In some countries there exists a traffic rule violation system in which repeated traffic rule violations are prosecuted more seriously than it would be the case for only one traffic rule violation. Due to this fact it may be important to consider driver- or traffic-related data. To exactly determine the sanctions, this parameter influencing the sanction has to be considered.

In step 550, the traffic rules are then compared to the driving parameter or to the driving parameters. The flowchart of FIG. 5 is continued in FIG. 6. When the driving parameters and the vehicle- or driver-related data are known, it is possible to determine the sanction resulting from the non-observance of one or more traffic rules (step 610). In step 620, it is determined whether the sanctions determined in step 610 are higher than a preset sanction limit value, as already discussed in connection with FIG. 3. If this is not the case, the driver will not be informed and the system continues as shown in the Figure with the letter B continuing on top of FIG. 5, so that the vehicle position is detected. If it is determined that the sanctions resulting from the non-observance of the traffic rule are greater than a sanction limit value (step 620), it may be asked in step 630 whether the driving parameter which is the reason for the sanction should be controlled automatically. This could be the case when the traffic rule violation and the corresponding possible sanction are considered to be of high significance. If the driving parameter is to be controlled automatically, the driving parameter will be adapted in step 640. After adapting the driving parameter, the way of informing the driver of the changed driving parameter and/or of the possible sanction has to be determined (step 650). This is also the case when it is decided in step 630 that the driving parameter should not be automatically controlled.

The driver may have configured the system in such a way that for different sanctions different ways of informing the driver are provided. It is possible to use different colors for different sanctions, e.g., a low sanction could be displayed in green color, a more severe sanction could be displayed in orange, a quite severe sanction could be displayed in red, etc. There are many different other ways of informing the driver of a possible sanction resulting from the non-observance of a traffic rule. Furthermore, it is possible to use the audio system of the vehicle to inform the driver of the sanction. Furthermore, other functions of a dashboard, e.g. the lightening of the dashboard, could be changed in order to inform the driver of a possible sanction. After determining the way of informing the driver in step 650, the driver is informed in step 660 of the possible sanction.

The system may also, according to the need of the driver, inform the driver of possible sanctions. The driver can configure the system in such a way that in all the cases, where the resulting sanction which may be due to different traffic rule violations is higher than a threshold value set by the driver, the driver will be informed. The driver can therefore easily avoid driving situations, which would lead to unwanted sanctions.

Figure 6:
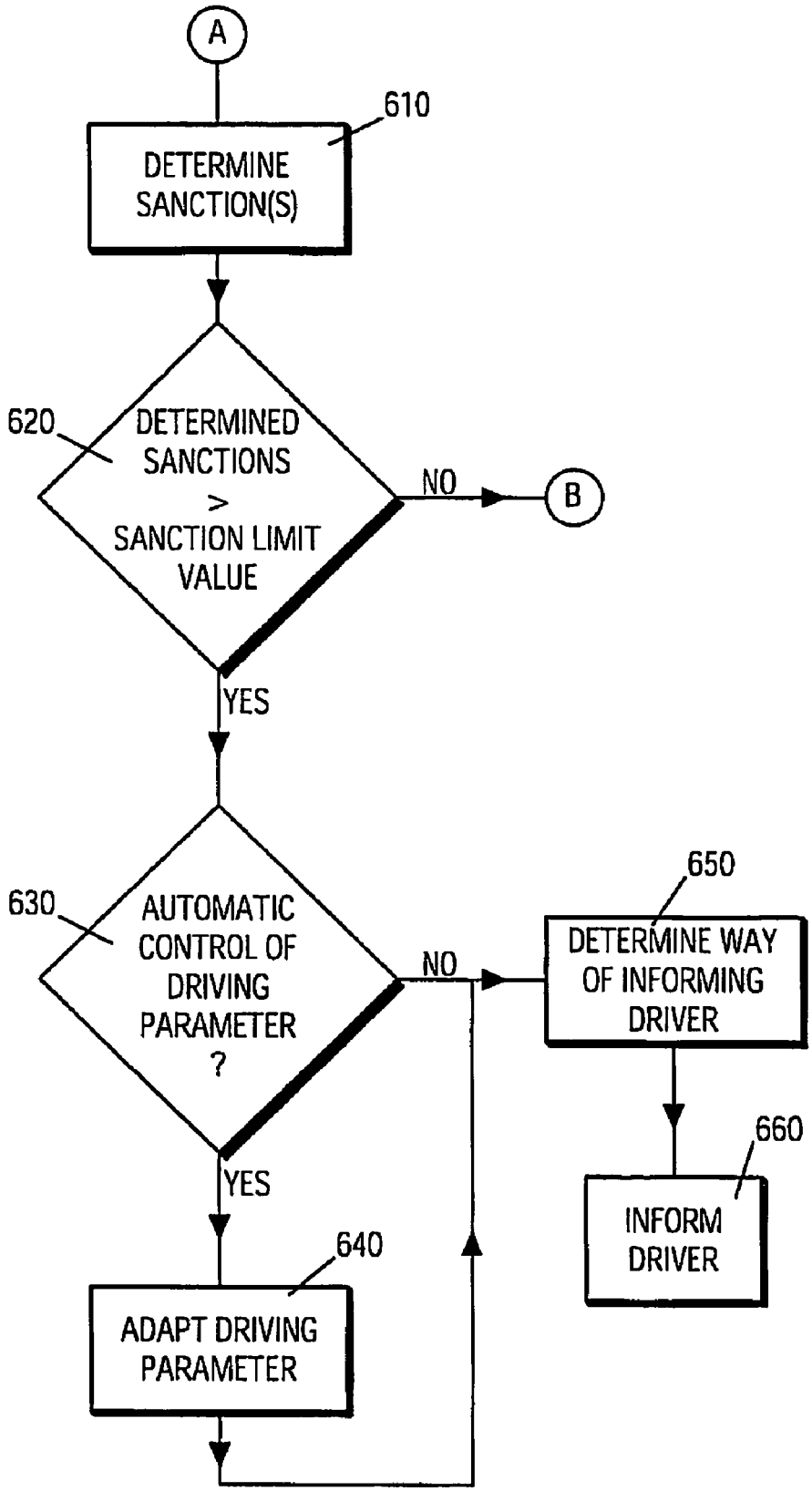
FIG. 6. is a continuation of the flowchart of FIG. 5 illustrating the steps how, in detail, a driver may be informed of a traffic rule violation and of the corresponding sanction.

Persons skilled in the art will understand and appreciate that one or more processes, sub-processes, or process steps described in connection with FIGS. 4-6 may be performed by hardware and/or software. Any software implementations may be executed within a processor or plurality of processor. Examples of a processor include but are not limited to microprocessor, general purpose processor, combination of processors, DSP, any logic or decision processing unit regardless of method of operation, instructions execution/system/apparatus/device and/or ASIC. If the process is performed by software, the software may reside in software memory (not shown) in the device used to execute the software. The software in software memory may include an ordered listing of executable instructions for implementing logical functions (i.e., "logic" that may be implemented either in digital form such as digital circuitry or source code or optical circuitry or chemical or biochemical in analog form such as analog circuitry or an analog source such an analog electrical, sound or video signal), and may selectively be embodied in any signal-bearing (such as a machine-readable and/or computer-readable) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "machine-readable medium," "computer-readable medium," and/or "signal-bearing medium" (herein known as a "signal-bearing medium") is any means that may contain, store, communicate, propagate, or transport the program for use by or in connection with the instruction execution system, apparatus, or device. The signal-bearing medium may selectively be, for example but not limited to, an electronic, magnetic, optical, electromagnetic, infrared, or semiconductor system, apparatus, device, air, water, or propagation medium. More specific examples, but nonetheless a non-exhaustive list, of computer-readable media would include the following: an electrical connection (electronic) having one or more wires; a portable computer diskette (magnetic); a RAM (electronic); a read-only memory "ROM" (electronic); an erasable programmable read-only memory (EPROM or Flash memory) (electronic); an optical fiber (optical); and a portable compact disc read-only memory "CDROM" "DVD" (optical). Note that the computer-readable medium may even be paper or another suitable medium upon which the program is printed, as the program can be electronically captured, via, for instance, optical scanning of the paper or other medium, then compiled, interpreted or otherwise processed in a suitable manner if necessary, and then stored in a computer memory. Additionally, it is appreciated by those skilled in the art that a signal-bearing medium may include carrier wave signals on propagated signals in telecommunication and/or network distributed systems. These propagated signals may be computer (i.e., machine) data signals embodied in the carrier wave signal. The computer/machine data signals may include data or software that is transported or interacts with the carrier wave signal.

It will be apparent to those of ordinary skill in the art that many more implementations are possible within the scope of this invention than those set forth above. The foregoing description of an implementation has been presented for purposes of illustration and description. It is not exhaustive and does not limit the claimed inventions to the precise form disclosed. Modifications and variations are possible in light of the above description or may be acquired from practicing the invention. For example, the described implementation includes software but the invention may be implemented as a combination of hardware and software or in hardware alone. Note also that the implementation may vary between systems. The claims and their equivalents define the scope of the invention.

The invention claimed is:

1. A system comprising:

a traffic rule database comprising traffic rules and corresponding sanctions for violating the traffic rules for geographical regions;

a position detecting unit to detect an actual position of a vehicle;

a driving parameter detecting unit to detect at least one driving parameter of the vehicle;

a control unit operable to extract relevant traffic rules for actual position of the vehicle from the traffic rule database and to compare the extracted traffic rules to the detected at least one driving parameter in order to detect a traffic rule violation; and a traffic rule violation significance judgment unit to judge the significance of a traffic rule violation detected by the control unit based on the sanction corresponding to the traffic rule violated and to decide whether information regarding the detected traffic rule violation is presented to a driver.

2. The system of claim 1 where the traffic rule violation significance judgment unit informs the driver of a detected driving parameter and the corresponding possible sanction resulting from the non-observance of a traffic rule.

3. The system of claim 2 where the traffic rule violation significance judgment unit decides whether traffic rule violation information is presented to the driver based on the corresponding sanction of the non-observance of a traffic rule.

4. The system of claim 3 where the significance of a traffic rule violation is judged by comparing the corresponding sanction to a sanction limit value set by the driver.

5. The system of claim 2 further comprising a memory unit comprising vehicle-related and/or driver-related data which are taken into consideration for the determination of the traffic rules and/or the sanctions depending on the vehicle related or driver related data.

6. The system of claim 1 further comprising a parameter variation information unit, which compares the detected driving parameter to a sanction related to the driving parameter and which informs the driver that a change of a driving parameter by a certain amount would result in a corresponding change of the sanction.

7. The system of claim 1 where the driving parameter detecting unit detects at least one of the following driving parameters: the country in which the vehicle is moving, the kind of road on which the vehicle is travelling, the driving speed, the type of vehicle, the weather condition outside the vehicle, the distance to another vehicle driving in front of the vehicle.

8. The system of claim 1 further comprising a vehicle control unit, which actively controls the driving parameters when a violation of a traffic rule would result in a predetermined sanction.

9. The system of claim 1 further comprising a geographical database comprising map data representing physical features of geographical regions, wherein the traffic rules are assigned to the map data of geographical regions, the control unit determines the position of the vehicle on the map based on the detected actual vehicle position and extracts the assigned traffic rules from the traffic rule database.

10. The system of claim 1 comprising an information unit for informing the driver of a traffic rule violation, wherein the type of information presented on the information unit depends on the non-observed traffic rule and/or the corresponding sanction.

11. The system of claim 1 where the traffic rule database, the control unit, and/or the traffic rule violation significance judgment unit is/are arranged at a centralized server unit for serving a plurality of vehicles having an on-board communication unit mounted for communicating with the centralized server unit.

12. A method comprising:

detecting the actual position of a vehicle;

detecting at least one driving parameter for the vehicle;

extracting traffic rules for the detected vehicle position from a traffic rule database comprising traffic rules and corresponding sanctions for geographical regions;

comparing the extracted traffic rules to the detected at least one driving parameter; and judging the significance of a traffic rule violation based on the sanction corresponding to the traffic rule violated and deciding, whether information regarding the detected traffic rule violation is presented to the driver.

13. The method according to claim 12, further comprising the step of informing the driver of the detected at least one driving parameter and of the corresponding possible sanction for the driver in case of non-observance of traffic rules.

14. A method according to claim 12 where the significance of a traffic rule violation is judged by comparing the corresponding sanction to a sanction limit value set by the driver.

15. A method according to claim 12 where for the determination of the traffic rules and/or for the determination of the sanctions, vehicle-related data and/or driver-related data are taken into consideration.

16. A method according to claim 12 further comprising the step of comparing the detected driving parameter to a sanction related to said driving parameter and informing the driver that a change of a driving parameter by a certain amount would result in a corresponding change of the sanction.

17. A method according to claim 12 further comprising the step of automatically controlling the driving parameter when the violation of the traffic rule would result in a predetermined sanction in case of non-observance of the traffic rule.

18. A method according to claim 12, further comprising the step of informing the driver of a traffic rule violation, wherein the type of information presented to the driver depends on the non-observed traffic rule and/or the corresponding sanction.

19. A method according to claim 12, where the traffic rules are extracted from a traffic rule database which is arranged at a centralized server unit outside the vehicle, the vehicle and the centralized server unit using wireless communication technologies.

20. A method according to claim 12, where the step of detecting a driving parameter comprises at least one of the following steps: detecting the country in which the vehicle is moving, detecting the kind of road on which the vehicle is moving, detecting they type of vehicle the driver is using, detecting driver related information, detecting the vehicle speed, detecting the weather conditions outside the vehicle, detecting the presence of any special permits of the vehicle or the driver, detecting the distance to another vehicle driving in front of the vehicle, detecting the time, detecting whether the driver is using a mobile phone, detecting the driving direction and comparing the latter to direction restrictions comprised in the map data, detecting whether the lights are turned on, detecting the loading of the vehicle.

* * * * *